US006428007B2

(12) United States Patent
Skeuse et al.

(10) Patent No.: US 6,428,007 B2
(45) **Date of Patent: *Aug. 6, 2002**

(54) ENVIRONMENTALLY SAFE PROJECTABLE TARGETS

(75) Inventors: Brian Skeuse, Flemington, NJ (US); Rupert Spencer, Carl Junction, MO (US)

(73) Assignee: Reagent Chemical & Research, Inc., Middlesex, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/337,631

(22) Filed: Jun. 21, 1999

Related U.S. Application Data

(63) Continuation of application No. 08/857,813, filed on May 16, 1997, now Pat. No. 5,947,475.

(51) Int. Cl.[7] ..... F41J 9/16
(52) U.S. Cl. ..... 273/363
(58) Field of Search ..... 273/362, 317; 524/270; 264/333

(56) References Cited

U.S. PATENT DOCUMENTS

| | | | | |
|---|---|---|---|---|
| 1,699,694 A | | 1/1929 | Ellis | |
| 1,761,740 A | | 6/1930 | Norlander | |
| 2,568,279 A | | 9/1951 | Franz et al. | |
| 2,576,565 A | | 11/1951 | Brown | |
| 2,833,659 A | | 5/1958 | Bauer | |
| 3,109,742 A | | 11/1963 | King | |
| 3,554,552 A | | 1/1971 | Nixon et al. | |
| 3,840,232 A | * | 10/1974 | Ludwig et al. | 273/362 |
| 3,884,470 A | * | 5/1975 | Paulson | 273/362 |
| 3,975,494 A | | 8/1976 | Tritenne | |
| 4,062,694 A | | 12/1977 | Sawyer, Jr. | |
| 4,124,550 A | * | 11/1978 | Kobayashi et al. | 524/270 |
| 4,125,550 A | | 11/1978 | Kobayashi et al. | |
| 4,133,669 A | | 1/1979 | Caldwell et al. | |
| 4,271,118 A | * | 6/1981 | Schreiner-Hansen | 264/333 |
| 4,568,087 A | | 2/1986 | Schreine-Hansen | |
| 4,623,150 A | * | 11/1986 | Moehlman et al. | 273/362 |
| 5,316,313 A | | 5/1994 | Moore | |
| 5,389,142 A | | 2/1995 | Moore | |
| 5,397,132 A | | 3/1995 | Maryska | |
| 5,788,243 A | | 8/1998 | Harshaw et al. | |

FOREIGN PATENT DOCUMENTS

| | | |
|---|---|---|
| CA | 959 203 | 12/1974 |
| DE | 2 254 725 | 5/1973 |
| DE | 24 39 247 | 1/1976 |
| DE | 26 27 695 | 12/1976 |
| EP | 0 487 381 | 5/1992 |
| GB | 2 066 235 | 7/1981 |
| JP | 73-58699 | 4/1973 |
| JP | 52-48300 | 4/1977 |
| JP | 52-99994 | 8/1977 |
| WO | WO 94/09339 | 4/1994 |

* cited by examiner

*Primary Examiner*—Paul T. Sewell
*Assistant Examiner*—M. Chambers
(74) *Attorney, Agent, or Firm*—Stroock & Stroock & Lavan LLP

(57) ABSTRACT

A shooting activity and a clay target which can be formed without pitch for use in such activity is provided. The activity involves shooting shot at the target and breaking targets hit by the shot. The target can be formed with a binder and filler and cast into a strong yet brittle state. Targets in accordance with the invention should be substantially pitch free and have a high LD 50 toxicity level as well as high frangibility. This can be accomplished in accordance with the invention by forming the targets with high internal stresses such as are formed by forming targets in unstable crystal states.

25 Claims, 1 Drawing Sheet

ENVIRONMENTALLY SAFE PROJECTABLE TARGETS

This is a continuation of application Ser. No. 08/857,813, filed May 16, 1997, titled Environmentally Safe Projectable Targets, now U.S. Pat. No. 5,947,475.

BACKGROUND OF THE INVENTION

The invention relates generally to a new composition of matter for use as a projectable, frangible and friable object and more particularly to a shooting activity such as trap and skeet shooting with an environmentally acceptable target.

The appearance of a typical target, also known as a "clay pigeon", which can be used for trap and skeet shooting, is shown as a target 10 in FIGS. 1–3. In use, target 10 is commonly launched from a launching device or trap 20 at a high velocity and generally flies away from a shooter 30, armed with a shotgun 40. Shooter 30 aims shotgun 40 towards flying target 10 and fires a pattern of shot or pellets 50 from gun 40 towards target 10 with the intent to strike and shatter target 10. Thus, to increase the enjoyment of shooter 30, target 10 must be sufficiently frangible and friable that it will shatter when struck by a relatively low number of pellets 50. With respect to unbroken targets hit by at least one pellet, as a general rule, it is desirable for less than about 10% of these targets to have been hit by three or more pellets. In the best targets, this percentage will be less than about 4%.

Target 10 should also be able to be "smoked" i.e., reduced to a cloud of powder or small fragments, when hit by a considerable number of pellets 50. It is extremely frustrating to shooters, if they hit target 10, but target 10 does not break, or if they make a perfect shot on target 10 and the target merely breaks into a relatively small number of pieces, without providing the "smoked" effect. In general, at least about 80% of the targets broken from shot should break into five or more pieces when shot at by shooters skilled enough to break over about 98% of the conventional pitch targets they shoot at. With the best targets, this percentage broken into 5 or more pieces will be about 90%.

In addition to being readily shattered, target 10 must be sturdy enough to remain intact, despite being subjected to considerable force by launcher 20. Upon leaving a trap, the target is commonly traveling at a top speed of about 92 miles per hour. A target is unacceptable if even about 2% break apart when launched. Target 10 must also be sturdy enough to be stacked in a box, jostled during transportation, have a long shelf life when subjected to widely varying environmental condition and be relatively cheap. It is not satisfactory if even about 2% of the targets crack when stored for over 45 days and this number should be below 1% for the highest quality targets.

A standard commercial target for trap and skeet shooting is formed with petroleum or tar pitch as a binder, together with fillers such as clays, finely divided minerals and the like. An example of a widely used and well received conventional target is sold under the trademark WHITE FLYER. Such target is formed primarily of petroleum pitch and limestone powder. The target weighs approximately 95 grams. It is approximately 4.25 inches in diameter and approximately 1.12 inches in height.

Trap and skeet shooting is generally conducted out of doors. Thus, when conventional pitch targets shatter and fall to the ground, they can cause various environmental concerns. For example, there is some concern that if eaten by an animal, the sharp edges of a broken target or the materials of a target's construction will cause internal problems to the animal. Also, the ground can appear littered and the petroleum base of the pitch has caused some environmental concern.

Over the years, various proposals have been made to produce clay targets with fewer environmental concerns. For example, U.S. Pat. No. 3,884,470 describes a target made from sulfur and various additives. German Patent No. 24 39 247 describes a target made with sulfur, filler and a plasticizer such as styrene. U.S. Pat. No. 4,623,150 describes a target made of filler and binder, in which the ingredients are mixed with solvent, packed into the shape of a target and the solvent is driven off. U.S. Pat. No. 3,840,232 describes targets formed with sulfur and limestone dust and describes the use of clay additives. International Publication No. WO 94/09339 discusses the use of various fillers such as sulfur and chalk. Canadian Patent No. 959203 and German Patent No. 22 54 725 also describe pitch free targets. The contents of each of these patents is incorporated herein by reference.

The targets formed in accordance with these patents have not proved to be fully satisfactory and to date, no pitch free target has been accepted in the marketplace. Some of the pitch free targets are too strong, i.e., they do not break even when hit with a relatively large number of pellets. For example, a target sold by of I.F.O. of Aura, Finland rarely shatters, even when hit with a perfect shot. Some pitch free targets break when launched by the trap or develop cracks when stored for several months. Some are too plastic, i.e., they are not easily removed from a mold, nor do they hold their shape, nor break when impacted with a relatively large number of pellets.

Accordingly, it is desirable to provide an improved target which overcomes the shortcomings of the prior art.

SUMMARY OF THE INVENTION

Generally speaking, in accordance with the invention, a shooting activity and a target which can be formed without pitch for use in such activity is provided. The activity involves shooting shot at the target and breaking targets hit by the shot. While some targets will be hit by at least one shot pellet and remain unbroken, under 25% of unbroken targets hit by one or more pellets will have been hit by three or more pellets. The targets will also consistently break into 5 or more pieces when hit by several pellets.

The target can be formed with a binder and filler and cast into a strong yet brittle state. When sulfur is chosen as the binder, the target preferably includes a sulfur modifier, such as lignin sulfonate. Fillers include limestone powder, clays and other inert solid powders. Other materials for improving the properties of the targets, such as degradation promoters and fire retardants can also be included.

Targets in accordance with the invention should be substantially pitch free and have an LD 50 toxicity level greater than 15 g/kg as well as high frangibility. This can be accomplished in accordance with the invention by forming the targets with high internal stresses such as are formed by forming targets in unstable crystal states. A preferred method of forming the targets is to heat the ingredients to a temperature above which the structure of the material changes, (320° F. in the case of the sulfur), maintain such temperature for an extended period of time to effect such change (preferably about an hour in the case of the sulfur) and then cast the targets below this temperature, (such as at a temperature of 270° F. for sulfur) to yield a target in an unstable physical state, which will shatter on impact. As a result, targets having LD 50 levels believed to be at least 20 times greater than conventional pitch targets can be achieved.

Accordingly, it is an object of the invention to provide an improved friable target.

Another object of the invention is to provide a friable target that is substantially free of pitch.

A further object of the invention is to provide a pitch free target which has the flying and shattering characteristics of a conventional pitch target.

Still another object of the invention is to provide a shooting activity which will cause fewer environmental concerns.

Still a further object of the invention is to provide an improved method of forming friable targets.

Still other objects and advantages of the invention will in part be obvious and will in part be apparent from the specification and drawings.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figures 1, 2, 3:
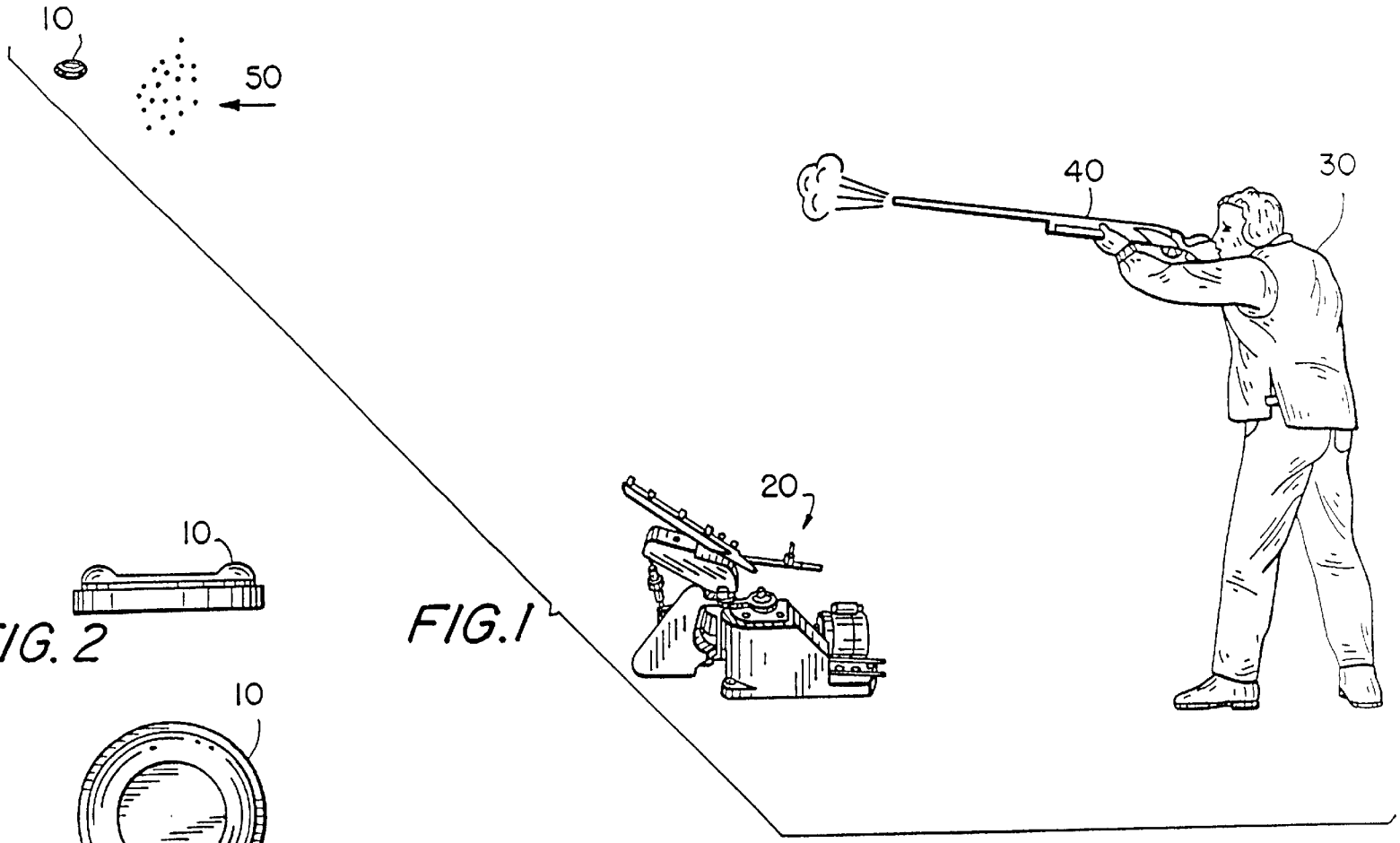
FIG. 1 is a perspective view of a shooter engaged in a shooting activity in which shot pellets are fired at a flying friable target.
FIG. 2 is a side view of the target of FIG. 1.
FIG. 3 is top plan view of the target FIG. 1.

The invention relates to a shooting activity having a reduced environmental impact by utilizing targets which can be made to be substantially pitch free; can be stored for extended periods of time under adverse atmospheric conditions; and can still be broken when hit by a minimal number of shot pellets. For example, in preferred embodiments of the invention where an unbroken target was hit by at least one pellet, well under about 10% and more desirably under about 5% of these targets will have been hit by three or more pellets fired from a shotgun and remained unbroken. This information can be obtained by performing the shooting activity with a conventional trap, and shooting it a distance of 27 yards with 12 gauge shotguns. Unbroken targets are then visually inspected for scratches or pockets caused by pellets hitting, but not breaking the targets. In addition, targets in accordance with preferred embodiments of the invention will break into five or more pieces well over 80% of the time when hit by shooters skilled enough to break about 98% of the targets they shoot at. When unskilled shooters perform the shooting activity in accordance with the invention, too many of the broken targets will be hit with "poor" shots and the results are less reproducible.

Targets in accordance with preferred embodiments of the invention should be formed in a friable and frangible state and can lack pitch or other environmentally undesirable ingredients. The following ingredients are advantageously included in a target formed in accordance with preferred embodiments of the invention.

Binders, and in particular sulfur are advantageously included in the targets of the invention. The binder must be strong enough to maintain the integrity of the target, yet be sufficiently unstable to be readily broken under appropriate conditions. Other binders include various resins, waxes, glucosides, starches, sugars, ureas and thermoplastic materials that are capable of exhibiting friable or brittle properties. It is preferred that environmentally undesirable binders are avoided. Sulfur is preferably included as about 35–45%, more preferably about 40–42% of the mix.

Fillers are advantageously added to the target composition. Preferred fillers are inert, solid, not significantly hydroscopic and environmentally acceptable. Calcium carbonate (limestone) especially in a finely ground form has proven to be a preferred filler. Other fillers include gypsums, sands, clays, fly ash, glass, metallic sulfates, non-metallic sulfates, ground igneous, sedimentary or metamorphic rock, metal oxides and silicates.

Limestone is readily available in most parts of the world and is inexpensive compared to many other fillers, such as graded sand and calcium sulfonate. Calcium carbonate has also been shown to be not only environmentally safe, but to promote the neutralization of acids which may be produced by reactions between sulfur in targets and compounds in the soil. In fact, it has been found that applying a combination of calcium carbonate and sulfur powder to plants can lead to various beneficial effects.

Calcium carbonate can be included as about 30 to 60% of the target with varying results. Employing approximately 50% affords considerable cost effectiveness, while still providing a product with workable consistency and an end product of proper weight and density. Deviating by more than about 1 or 2% from the 50% figure in certain compositions involving a sulfur binder can lead to significant loss in strength, flowability, mixability, target weight and friability.

Modifiers are also advantageously included in targets in accordance with the invention to improve molding properties as well as the brittleness of the finished product. For example, when sulfur is used as a binder, lignin sulfonate is advantageously added, in a preferred range of about 2% to 8%, more preferably about 5% of the weight of sulfur added, or about 1% to 4% and more preferably, about 2% of the weight of the mix.

Degradation promoters are also desirable. Even if the target is environmentally benign, the fragments of a broken target can be sharp and may cause internal injuries if swallowed by an animal. Broken targets littering a field can also be unsightly. Accordingly, it is desirable to include a degradation promoter, such as a water swellable clay, which will expedite the degradation of used targets.

Degradation promoters, such as water swellable clays, particularly aluminum silicate (bentonite clay) can also serve as a mixing aid to improve the smoothness of the material during mixing and casting. The degradation promoter (aluminum silicate) is advantageously included as 2 to 4% of the weight of the mix. Insufficient degradation promoter does not tend to produce the desired effect of mix smoothness and environmental breakdown. Excess degradation promoter is costly, can lead to premature degradation of the final product during storage and softer, less brittle targets. Excessive degradation promoter can also affect the structure of the target, such as leading to cracks formed by the release of internal stresses.

Fireproofing agents are advantageously included in the target. For example, if a target includes sulfur and target fragments in a field are exposed to fire, such as during a brush fire, or a warehouse storing the targets catches fire, it is desirable to prevent the target from igniting and releasing sulfur containing gases into the air. A particularly well suited fire suppressant is polyvinyl chloride (PVC). The addition of 2 to 10%, preferably 4 to 9% fire suppressant (PVC) is advantageous. The PVC is included by mixing PVC powder with the other ingredients prior to casting. PVC is both degradable by ultraviolet light and bacteria which occur in nature.

Flow additives are also advantageously included in the target mixture. Magnesium stearate, particularly in about 0.5% by weight of the target mixture will improve the flowability of the mixture and act as a lubricant to enhance release of cast targets from the molds. Including less magnesium stearate may not lead to the desired properties and using more than 0.5% magnesium stearate is costly and may not lead to significantly improved properties. Nevertheless, using more than about 0.25% will be suitable for some applications.

Pigments, such as carbon black, can be used to impart a desired appearance to the target. The addition of carbon black also lead to a somewhat improved flow rheology. The use of approximately 0.12% has been found to be suitable. The finished product can also be painted to change its appearance. For example, a fluorescent orange color can be applied to the top thereof. Also, various known fire retardant paints, such as latex fire retardant paints, can assist in rendering the product incapable of supporting flammability on its own.

Although the mechanism for forming friable targets is not fully understood, it is believed to relate to the ability to cast targets in an unstable form. For example, sulfur is an $S_8$ molecule and is normally connected in a ring form. It is believed that by heating sulfur, it is possible to open the ring to form a chain of sulfur atoms. Continued heating is believed to link the chains to form sulfur "polymer" or "oligimer" chains in the heated state. This is evidenced by a change in viscosity above sulfur's melting point from a temperature of 320° F. to 370° F.

While cast sulfur is initially in a monoclinic crystalline structure, sulfur's stable state below 203° F. is rhombic. Rhombic sulfur has a crumbly chalk-like structure. As cast monoclinic sulfur reverts to a rhombic state, built up stresses and energy are released and a cracked and/or structurally weak solid is produced. Thus, it is preferable to maintain as much of the sulfur as possible in the monoclinic state as this will maintain the internal stresses which promote brittleness, while preventing cracking and a weak solid.

It is believed that if lignin sulfonate is present when the sulfur molecules are opened during heating, the open chains of sulfur will link to the lignin sulfonate compound and form polymer type compounds including sulfur and lignin sulfonate. Thus, the sulfur will be unable to return to $S_8$ rings when the temperature is reduced. It is believed that by bonding to the opened sulfur chains, the lignin sulfonate is effective in preventing the monoclinic crystal structure which forms on initial cooling from reverting to a rhombic structure which is more stable at lowered temperatures. The foregoing actions of lignin sulfonate are considered to create stress and thereby store potential energy in the material, leading to material having the correct balance of strength and brittleness.

It is believed that if the sulfur/lignin sulfonate combination is maintained at a temperature of over approximately 350° F. for more than approximately 1 hour, a sufficient amount of "polymers" of sulfur and lignin sulfonate will form. It is believed that if higher temperatures or longer heating periods are employed, the material will become undesirable vicious, which will interfere with processing. If significantly less time or temperature is employed, it is believed that an insufficient number of sulfur rings will open and bond with the lignin sulfonate, leading to a target having lower potential energy and therefore undesirably low friability.

Preferred embodiments of the invention will be explained with reference to the following examples, which are provided for purposes of illustration only and are not intended to be construed in limiting sense.

EXAMPLE 1

A target composed of 41% sulfur, 38% limestone powder, 9% Bentonite clay, 9% PVC, 2% lignin sulfonate and 1% magnesium stearate was prepared. First, the sulfur was melted and all the ingredients were added simultaneously. The mixture was then heated to 350° F. and held at this temperature for one hour. Afterwards, the mixture was cooled to 270° F. and targets were cast in conventional target casting molds. After casting into the saucer shape of FIGS. 2–3, the top and bottom of the targets were painted with fire retardant paint. The resulting targets had the approximate weight and feel of conventional pitch targets. When struck with a hard object, they emitted the familiar plink sound of a highly frangible object, such as a conventional target or a china plate.

The targets were found to have significant shelf life and were strong enough to be launched from a conventional trap. In addition, the targets shattered into numerous pieces when struck by a relatively low number of pellets fired from a conventional shotgun during ordinary trap and skeet shooting. The targets could not sustain flammability on their own and degraded into a powder relatively quickly when subjected to environmental exposure testing.

EXAMPLE 2

Targets were manufactured from 50% finely ground limestone powder, 41% sulfur, 3% aluminum silicate, 0.5% magnesium stearate, 0.12% carbon black, 4% PVC powder and 2% lignin sulfonate (5% by weight of sulfur). Molten sulfur at a temperature of 260° F. was charged with all dry ingredients in proper ratios, except for the PVC powder, under conditions of continuous mixing and maintained at this temperature. The temperature of the mixture was then elevated to 350° F. and retained at this temperature for one hour, under agitation, to allow the modification and compounding of ingredients. The temperature of the mixture was then lowered to between 265 and 275° F. and the PVC powder was added under continuous mixing, until the powder was completely dispersed and the mixture was homogenous. The molten mixture was then cast into the sauce shape of FIGS. 2–3 using conventional casting techniques and the finished product was painted with fire retardant latex paint immediately after removal from the casting machine.

The resulting targets had the approximate weight and feel of conventional pitch targets. When struck with a hard object, they emitted the familiar plink sound of a highly frangible object, such as a conventional target or a china plate. The targets were found to have significant shelf life and were strong enough to be launched from a conventional trap. The targets could not sustain flammability on their own and degraded into a powder relatively quickly when subjected to environmental exposure testing.

The targets shattered into numerous pieces when struck by a relatively low number of pellets fired from a conventional shotgun during ordinary trap and skeet shooting. Of targets which had been hit by at least one pellet during a shooting exercise but remained unbroken, well below 50% of these had been hit by more than two pellets. When shot at by skilled shooters who are able to break at least about 98% of the targets they shoot at, well over 50% and typically over 90% of the targets which were hit broke into more than five pieces.

COMPARATIVE EXAMPLES

In order to confirm that targets in accordance with the invention represent a marked improvement over targets produced by reasonable efforts to follow the teachings of various prior art references, an effort was made to produce targets in accordance with the teachings of those prior art references. In this undertaking, exact quantities and percentages discussed therein were used where available. Where ranges were given, a middle value was selected. As demonstrated below, the targets produced by this effort to replicate the prior art were orders of magnitude below those formed in accordance with the invention, in terms of acceptability as a substitute for conventional pitch based targets.

COMPARATIVE EXAMPLE A

Referring generally to U.S. Pat. No. 3,884,470, a mixture containing elemental sulfur and 1% lignin sulfonate was mixed and heated to a temperature of 350° F. in an electrically heated pot under conditions of continuous mixing. The heated mixture was ladled into a target mold cooled with 50° F. water circulating through the mold jacket and compressed for 30 seconds. Targets would not release from the mold without still further cooling and considerable difficulty. A second casting was made, using a lecithin mold release agent and 60 seconds of compression. It took approximately two minutes to remove a target from the mold. Increasing the mold time to 90 seconds and lowering the coolant water temperature to 40° F. still lead to a requirement of two minutes in order to remove targets from the mold. When the composition was held at 350° F. for approximately 40 minutes, casting was of a very plastic material which would neither release from the mold surface, nor hold its shape as cast if it did release. To the extent any targets were produced, they showed flaws of some kind, such as cracks, tears, stretching or complete collapse and could not be used in trap or skeet shooting.

COMPARATIVE EXAMPLE B

Referring generally to U.S. Pat. No. 3,840,232, a mixture containing 48% elemental sulfur, 48% limestone powder and 4% bentonite clay was mixed and heated in an electrically heated pot to a temperature of 260° F. A lecithin mold release agent was used and a material cast well with 11 seconds mold time. Although release was good, the targets exhibited a high percentage of cracks, which formed prior to removal of the targets from the dye. In an effort to eliminate this problem, the cooling water was removed from the dye in order to increase the temperature thereof and slow the cooling process. Although this was of some help in eliminating the cracking problem, it did not eliminate the cracking problem completely. After storing these targets for 30 days, 96% had cracked and would fall apart if moved even slightly.

COMPARATIVE EXAMPLE C

Referring generally to German Patent Publication No. 2439247, a mixture containing 68% elemental sulfur 24% white sand (70–325 mesh U.S. standard) were charged into an electrically heated pot and mixed at a temperature of 275° F. until the sulfur was melted and the sand was well blended. Maleic acid (2%) was added and dissolved into solution. The fumes at this point were very irritating to the eyes, nose and lungs. A styrene monomer (6%) was added at that point and mixed into compound. Even with an exhaust hood, the fumes were very irritating the styrene was difficult to blend homogeneously.

The mixture was charged to a mold for 10 seconds and 55° F. water was circulated in the mold. A lecithin mold release agent was used on the dye to assist in release. Nevertheless, the product would not release properly. Excess material had to be scraped from the dye, which had to be cleaned prior to casting a second target. The second target was also impossible to eject from the dye. Accordingly, six plate samples were poured onto aluminum foil in order to get a solid sample of the product. Even if the mold release problems were overcome, the resulting product would not be sufficiently brittle and thus, would not shatter properly when hit by a relatively low number of pellets. The material produced was not suitable for trap or skeet shooting.

COMPARATIVE EXAMPLE D

Referring generally to WO 94/09939, example 1, a mixture containing 45% elemental sulfur and 55% calcium carbonate (limestone or chalk powder) was mixed in an electrically heated pot at a temperature of 248° F. It was necessary to raise the temperature to 260° F., as the mixture at 248° F. was too thick to cast. Targets were cast with a mold temperature of 55° F. and a mold time of 5 seconds. Although the targets cast well, there was some cracking at the time of mold release. With this formulation and casting temperature, the solidification rate was so fast that it was necessary to cast exceptionally massive targets to maintain a sufficiently high temperature of the casting body while the mold was closing. An inspection of the product after 48 days of storage showed 100% to have cracked on reversion to the stable crystal structure.

COMPARATIVE EXAMPLE E

Referring generally to WO 94/09939, Example 4, a second mixture containing 45% elemental sulfur, 29% limestone powder and 30% white sand, said sand having a size range of 88% between 106 microns and 212 microns in particle size, were mixed in a electrically heated pot at 270° F. and cast in a mold using water at a temperature of 60° F. This mixture would not cast properly and targets with voids in the outer portion of the target were obtained. The mixture set too quickly and did not permit full dye closure. Although the release properties were good, the flowability was poor and the mixture was very abrasive. Some of the targets began cracking within a few minutes and after 13 days, 47% exhibited visual cracks. The unbroken target material had an insufficiently brittle quality to be used for trap and skeet shooting.

With respect to U.S. Pat. No. 4,623,150, the procedures described therein were followed and a target having inadequate friability resulted. Such targets were very difficult to break when shot by expert shooters and the examination of unbroken targets demonstrated that the targets often did not break when hit by as many as nine pellets. Less than 85% of targets struck by 3 or more pellets were broken. Also, even when broken, the targets broke into two to four pieces, instead of shattering into a myriad of fragments.

In view of the foregoing, it is clear that merely including ingredients common to those set forth in these patents (sulfur, lignin sulfonate, aluminum silicate, limestone or sand) will not yield an acceptable target, i.e. one which will cast well and break consistently when struck by three or more pellets. For example, even when a target was made with: sulfur and lignin sulfonate and heated to a temperature of 350° F.; sulfur, limestone and bentonite clay; sulfur, sand, limestone; or limestone, lignin sulfonate and magnesium stearate, the results are generally unsatisfactory.

An explanation regarding the unsatisfactory results of the prior art efforts may lie in a lack of a full understanding of the nature of the structure of the binder. For example, the stable crystalline form of sulfur below 203° F. is rhombic. From 203° F. to the melting point of 240° F., the stable crystalline form of sulfur is monoclinic. A period of time is required for this transformation to take place. Although the mechanics of the thermodynamic memory of sulfur is not completely understood, when sulfur is heated to a temperature of 320° F. to 350° F., the molecular structure of the sulfur changes, as the three allotropes reach a type of state of equilibrium during the period held at this temperature. This particular state of equilibrium of the three allotropes, it is believed, increases the amount of monoclinic crystals produced as the sulfur solidifies, which in turn allows for a greater number of these monoclinic crystals to be so modified as to be unable to revert to the orthorhombic form in their normal reversion cycle. This helps produce the desired friable product.

When a cooling target cools to below 203° F., it will attempt to revert to the rhombic form. When this reversion takes place, certain stresses and energy are released, forming cracks and structurally weak solids. This is evidenced by the amount of cracked and weak targets produced by the procedure set forth in U.S. Pat. No. 3,840,232 and WO 94/09939. Thus, it is believed that the use of sulfur alone, without proper modification and process control will not lead to the production of suitable targets. Also, it is believed that when sulfur is modified with lignin sulfonate alone at a temperature of 350° F. for a period of time, an unprocessable product results, as evidenced by the product produced by U.S. Pat. No. 3,884,470.

EXAMPLE 4

To demonstrate the exceptional performance of targets formed in accordance with the invention, targets formed in accordance with Example 2 were launched from a trap and shot at with a 12 gauge shotgun firing lead shot at a distance of 27 yards. The breakage results are compared to those of conventional pitch targets in Table 1, below.

TABLE 1

| SHOOTING TEST RESULTS TARGETS SHOT AT 27 YDS | | |
|---|---|---|
| SHOOTER | PITCH | EXAMPLE 2 |
| A | 46/50 44/50 | 48/50 46/49 |
| B | 42/50 43/50 | 44/50 41/50 |
| C | 43/50 46/50 | 44/50 45/50 |
| D | 48/50 44/50 | 47/50 49/49 |
| E | 47/50 46/50 | 45/50 47/50 |
| TOTALS | 449 Of 500 | 456 Of 498 |
| | 89.8% broken | 91.6% broken |

TABLE 1-continued

| PICKUP RESULTS OF UNBROKEN TARGETS | | |
|---|---|---|
| NO. PELLET MARKS | PITCH | EXAMPLE 2 |
| 0 | 13 | 10 |
| 1 | 6 | 7 |
| 2 | 5 | 3 |
| 3 | 4 | 0 |
| 4 | 1 | 1 |
| 5 | 2 | 0 |
| 6 | 0 | 0 |
| 7 | 1 | 0 |
| 8 | 0 | 0 |
| 9 | 0 | 0 |
| 10 | 0 | 0 |

As evident from Table 1, the targets formed in accordance with the invention outperformed high quality pitch targets and exhibit results which were orders of magnitude superior to those which would result from shooting at the targets of the Comparative Examples. It should be noted that of the 11 unbroken Example 2 targets recovered which had been hit by at least one pellet, only one had been hit by more than three pellets. Also, over 84% of the Example 2 targets which were hit and broke, broke into 5 or more pieces. Thus, the breakage results of the Example 2 targets are at least as good as those of a conventional pitch target.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A frangible, projectable shooting target, comprising:

a target composition comprising effective proportions of sulfur, filler and lignin sulfonate and substantially no pitch, cast from a melt and formed in a state of sufficient sturdiness that less than about 2% of such targets will break when launched from a trap and less than about 2% will develop cracks when stored for 45 days after casting and the targets are frangible enough that when launched from a trap, they will break into pieces when hit from pellets fired from a shotgun held by shooters standing at least 27 yards from the trap that launched the targets.

2. The target of claim 1, wherein the range of sulfur is about 35% to 45% by weight of the target material.

3. The target of claim 1, wherein the filler is selected from the group consisting of gypsums, sands, clays, fly ash, glass, metallic sulfates, non-metallic sulfates, ground igneous, sedimentary or metamorphic rock, metal oxides and silicates.

4. The target of claim 1, wherein the filler comprises of calcium carbonate.

5. The target of claim 1, wherein the sulfur is in the range of about 35% to 45% by weight of the target composition and the filler component comprises calcium carbonate.

6. The target of claim 1, wherein the target has substantially no pitch and an LD50 toxicity level greater than about 15 g/kg.

7. The target of claim 1, wherein the lignin sulfonate is in the range of about 2% to 8% of the weight of the sulfur added.

8. The target of claim 2, further including an effective amount of a degradation promoter to increase the rate of degradation when the target is exposed to moisture.

9. The target of claim 8, wherein the degradation promoter comprises aluminum silicate.

10. The target of claim 1, further including an effective amount of a fire suppressant to inhibit the targets from igniting when exposed to fire.

11. The target of claim 10, wherein about 2% to 10% fire suppressant material is included in the target composition.

12. The target of claim 1, comprising at least one application of a fire retardant paint to a portion of the target.

13. The target of claim 5, having an LD50 toxicity level greater than about 15 g/kg.

14. The target of claim 1, wherein the targets have sufficient frangibility to break into five or more pieces over about 80% of the time when hit by shooters firing bird shot from twelve gauge shotguns.

15. The target of claim 1, wherein the target has substantially the weight and dimensions of a conventional pitch target.

16. The target of claim 1, wherein the target is in the state achieved by heating the materials to a temperature of over about 320° F. for an hour, then casting at between about 240° F. and 320° F.

17. A target shooting target, comprising about 35% to 45% sulfur, about 30% to 60% filler and about 1% to 4% lignin sulfonate.

18. The target of claim 17, containing substantially no pitch.

19. The target of claim 17, further including a fire suppressant.

20. The target of claim 17, further including a degradation promoter.

21. The target of claim 17, wherein the filler component comprises calcium carbonate.

22. The target of claim 17, including an application of fire retardant paint.

23. The target of claim 17 wherein the targets are strong and durable enough to be maintained stacked in a box for over 45 days without developing cracks in more than about 2% of the targets.

24. A target for use in a shooting activity, having an LD50 of 15 g/kg or greater, comprising effective proportions of binder, filler, lignin sulfonate and substantially no pitch, and being in a state of brittleness characterized by the ability to be launched into the air from a trap without breaking more than 2% of the time and when shot at with a shotgun by shooters 27 yards from the trap that launched the target, breaking the majority of the time when hit by fired pellets, to the extent that less than 4% of unbroken targets hit by at least 1 pellets were hit by three or more pellets.

25. The target of claim 24, wherein the targets are strong and durable enough to be maintained stacked in a box for over 45 days without developing cracks in more than about 25 of the targets.

* * * * *